US006631919B1

(12) United States Patent
West et al.

(10) Patent No.: US 6,631,919 B1
(45) Date of Patent: Oct. 14, 2003

(54) WING-SHAPED LEG SUPPORT FOR A HIGHBACK

(75) Inventors: Brian West, Burlington, VT (US); Ryan Coulter, Stowe, VT (US); Stefan Reuss, Rum (AT)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/478,390

(22) Filed: Jan. 6, 2000

(51) Int. Cl.[7] ..... A63C 9/00

(52) U.S. Cl. ..... 280/633; 280/634; 280/11.36; 36/89

(58) Field of Search ..... 280/14.21, 14.22, 280/11.36, 617, 623, 624, 633, 634, 636; 36/89, 117.1, 118.3, 118.4, 118.7, 118.8, 118.9

(56) References Cited

U.S. PATENT DOCUMENTS

| | | | | |
|---|---|---|---|---|
| 4,203,235 A | | 5/1980 | Van Pelt, Jr. | 36/118 |
| 4,379,370 A | * | 4/1983 | Balbinot | 36/118.8 |
| 4,473,235 A | | 9/1984 | Burt | 280/11.36 |
| 4,575,955 A | | 3/1986 | Borsoi | 36/117 |
| 4,901,454 A | | 2/1990 | Walkhoff | 36/117 |
| 4,907,354 A | | 3/1990 | Benoit et al. | 36/119 |
| 4,910,881 A | | 3/1990 | Baggio et al. | 36/2.6 |
| 4,949,479 A | | 8/1990 | Ottieri | 36/117 |
| 5,152,085 A | | 10/1992 | Baggio et al. | 36/117 |
| 5,177,884 A | | 1/1993 | Rullier | 36/117 |
| 5,243,774 A | | 9/1993 | Mattiuzzo | 36/117 |
| 5,329,706 A | | 7/1994 | Pozzobon | 36/117 |
| 5,343,640 A | * | 9/1994 | Mattiuzzo et al. | 36/117.1 |
| 5,356,170 A | | 10/1994 | Carpenter et al. | |
| 5,417,443 A | | 5/1995 | Blattner et al. | |
| 5,425,187 A | | 6/1995 | Artusi et al. | 36/117 |
| 5,435,080 A | | 7/1995 | Meiselman | 36/117 |
| 5,556,123 A | | 9/1996 | Fournier | 280/607 |
| 5,575,015 A | | 11/1996 | Paris et al. | 2/240 |
| 5,575,091 A | | 11/1996 | Mattiuzzo | 36/118.2 |
| 5,636,455 A | | 6/1997 | Meiselman | 36/115 |
| 5,690,350 A | | 11/1997 | Turner et al. | 280/613 |
| 5,690,351 A | | 11/1997 | Karol | 280/618 |
| 5,692,765 A | | 12/1997 | Laughlin | 280/619 |
| 5,713,587 A | | 2/1998 | Morrow et al. | 280/14.2 |
| 5,718,066 A | | 2/1998 | Chemello et al. | 36/117.1 |
| 5,761,835 A | | 6/1998 | Okajima | 36/89 |
| 5,765,853 A | | 6/1998 | Erb | 280/607 |
| 5,771,609 A | | 6/1998 | Messmer | 36/89 |
| 5,802,741 A | | 9/1998 | Turner et al. | 36/117.3 |
| 5,806,212 A | * | 9/1998 | Benoit et al. | 36/118.9 |
| 5,813,688 A | | 9/1998 | Dacklin | 280/607 |
| 5,815,952 A | | 10/1998 | Bobrowicz | 36/117.3 |

(List continued on next page.)

FOREIGN PATENT DOCUMENTS

| | | | | |
|---|---|---|---|---|
| DE | 2746980 | * | 4/1979 | 280/11.36 |
| DE | 196 02 667 C1 | | 1/1996 | |
| DE | 195 41 644 A1 | | 5/1997 | |

(List continued on next page.)

OTHER PUBLICATIONS

Testing summary of "Wing Shaped Leg Support for Highback", Oct. 12, 1998.

(List continued on next page.)

*Primary Examiner*—Frank Vanaman
(74) *Attorney, Agent, or Firm*—Wolf, Greenfield & Sacks, P.C.

(57) ABSTRACT

A highback includes a wing-shaped leg support adjustably extending therefrom that cooperates with a rider's leg to transmit forces from the rider's leg to the highback. The support is movable between a plurality of positions relative to the highback so that the position of the support may be selectively adjustable by the rider to accommodate the rider's particular riding preferences. The adjustable support facilitates the selection of desired force transmission to the board and may enhance board control.

70 Claims, 10 Drawing Sheets

U.S. PATENT DOCUMENTS

| | | | | | |
|---|---|---|---|---|---|
| 5,819,440 | A | | 10/1998 | Okajima | 36/117.1 |
| 5,853,188 | A | | 12/1998 | Alden | 280/627 |
| 5,876,045 | A | | 3/1999 | Acuna, Jr. | 280/14.2 |
| 5,891,072 | A | | 4/1999 | Cady, Jr. | 602/27 |
| 5,901,469 | A | | 5/1999 | Saillet | 36/118.2 |
| 5,926,979 | A | * | 7/1999 | Borel | 36/118.3 |
| 5,937,546 | A | | 8/1999 | Messmer | 36/89 |
| 5,967,531 | A | * | 10/1999 | Saillet | 280/11.36 |
| 6,123,342 | A | | 9/2000 | Grell | 280/11.36 |
| 6,231,066 | B1 | * | 5/2001 | Okajima | 280/623 |

FOREIGN PATENT DOCUMENTS

| | | | | | |
|---|---|---|---|---|---|
| DE | 198 45 543 | A1 | | 4/1999 | |
| EP | 0 724 851 | A1 | | 8/1996 | |
| EP | 0 787 512 | A1 | | 8/1997 | |
| EP | 0 793 920 | A1 | | 9/1997 | |
| EP | 0 797 936 | A1 | | 10/1997 | |
| EP | 0 804 949 | A1 | | 11/1997 | |
| EP | 0 804 950 | A1 | | 11/1997 | |
| EP | 0 811 328 | A1 | | 12/1997 | |
| EP | 0 811 402 | A1 | | 12/1997 | |
| EP | 0 838 248 | A1 | | 4/1998 | |
| EP | 838248 | | | 4/1998 | |
| EP | 0 838 248 | B1 | | 4/1998 | |
| EP | 0 855 200 | A1 | | 7/1998 | |
| EP | 0 858 818 | A1 | | 8/1998 | |
| EP | 0 898 990 | A1 | | 3/1999 | |
| EP | 0 920 889 | A1 | | 6/1999 | |
| FR | 2448361 | | * | 10/1980 | 280/11.36 |
| FR | 2 623 415 | | | 5/1989 | |
| FR | 2 673 546 | | | 9/1992 | |
| FR | 0 765 116 | | | 12/1998 | |
| JP | 9-253267 | | | 9/1997 | |
| JP | 9-262335 | | | 10/1997 | |
| WO | 83/02397 | | * | 7/1983 | 280/11.36 |
| WO | WO 98/14247 | | | 4/1998 | |
| WO | WO 98/31247 | A1 | | 7/1998 | |

OTHER PUBLICATIONS

Burton Snowboards 1996 Catalog, p. 24, "System".

Burton Snowboards 1995 Catalog, p. 23, "Torque Binding".

Burton Snowboards 1994 Catalog, p. 15, "3D Tourque Binding".

Distributor Information Sales Manual, "Binding Technology", 4 pp., Jan. 1994.

* cited by examiner

WING-SHAPED LEG SUPPORT FOR A HIGHBACK

BACKGROUND OF THE INVENTION

1. Field of the Invention

The present invention relates generally to a highback for gliding sports, such as snowboarding, and, more particularly, to a wing-shaped leg support for a highback.

2. Description of the Related Art

Snowboard bindings are employed to mount a boot to a snowboard. Oftentimes, the binding or the boot includes an upright member, called a "highback" (also known as a "lowback" and a "skyback"), that interacts with a rear portion of a rider's leg. The highback, whether mounted on the binding or on the boot, acts as a lever that helps transmit forces directly to and from the board, allowing the rider to efficiently control the board through leg movement. For example, flexing one's legs rearward against the highback places the board on its heel-edge with a corresponding shift in weight and balance acting through the highback to complete a heel-side turn.

Snowboard bindings typically are mounted to a snowboard to allow the rider to select a desired stance angle of the binding relative to the board. Specifically, the angle between the midline of the binding and the midline of the snowboard can be altered for different riding styles, such as trick riding, backcountry riding or simple traveling, and for different riders and riding preferences. The stance angle may range from 0° to 45° or more. Once the desired stance angle is set, a rider may wish to reposition the highback, whether mounted to a binding or to a boot, so that the highback is generally aligned with the heel-edge of the board. Aligning the highback with the heel-edge of the board enhances force transmission from the rider's leg to the board as the rider leans against the highback during a heel-side turn. This may be accomplished by mounting the highback for lateral rotation about a substantially vertical axis.

It is an object of the present invention to provide a highback for board control.

SUMMARY OF THE INVENTION

In one illustrative embodiment, a highback for use with a component that interfaces with a rider's leg and is supportable by a gliding board is provided. The highback includes a highback body that is constructed and arranged to be mounted to the component and to be contacted by a rear portion of the rider's leg. The highback further includes a wing-shaped leg support adjustably extending in a lateral direction from the highback body. The wing-shaped leg support is constructed and arranged to cooperate with the rider's leg to transmit forces from the rider's leg to the highback body. The wing-shaped leg support is movable between a plurality of positions relative to the highback body so that the position of the wing-shaped leg support relative to the highback body may be selectively adjusted by the rider.

In another illustrative embodiment, a system for use with a component that interfaces with a rider's leg and is supportable by a gliding board is provided. The system includes a highback that is constructed and arranged to mount to the component and to be contacted by a rear portion of the rider's leg. The system also includes a plurality of interchangeable leg supports. Each support is constructed and arranged to be mounted to the highback and to laterally extend from the highback. Each support is constructed and arranged to cooperate with the rider's leg to transmit forces from the rider's leg to the highback.

In another illustrative embodiment, a wing-shaped leg support for use with a highback is provided. The highback is used with a component that interfaces with a rider's leg and is supportable by a gliding board. The wing-shaped leg support includes a body portion and a wing portion extending from the body portion. The wing-shaped leg support is constructed and arranged to cooperate with the rider's leg to transmit forces from the rider's leg to the highback. A plurality of attachment points is formed on the body portion that is constructed and arranged to mount the wing-shaped leg support in a plurality of positions relative to the highback so that the position of the wing-shaped leg support relative to the highback may be selectively adjusted by the rider.

In yet another illustrative embodiment, a wing-shaped leg support for use with a highback is provided. The highback is used with a component that interfaces with a rider's leg and is supportable by a gliding board. The wing-shaped leg support includes a body portion and a wing portion extending from the body portion. The wing-shaped leg support is constructed and arranged to cooperate with the rider's leg to transmit forces from the rider's leg to the highback. A reinforced section is formed between the body portion and the wing portion.

Various embodiments of the present invention provide certain advantages. Not all embodiments of the invention share the same advantages and those that do may not share them under all circumstances. This being said, the present invention provides numerous advantages including the noted advantage of providing a rider-adjustable highback.

Further features and advantages of the present invention, as well as the structure and operation of various embodiments of the present invention are described in detail below with reference to the accompanying drawings.

BRIEF DESCRIPTION OF THE DRAWINGS

The invention will now be described, by way of example, with reference to the accompanying drawings, in which.

DETAILED DESCRIPTION

The present invention is directed to a highback configured for adjusting the lateral extent of the highback. The highback is provided with a wing-shaped leg support adjustably extending therefrom that cooperates with a rider's leg to transmit rider-induced forces from the rider's leg to the highback. The wing-shaped leg support is movable between a plurality of positions relative to the highback so that the position of the wing-shaped leg support may be selectively adjusted by the rider to accommodate the rider's particular riding preferences.

Figure 1:
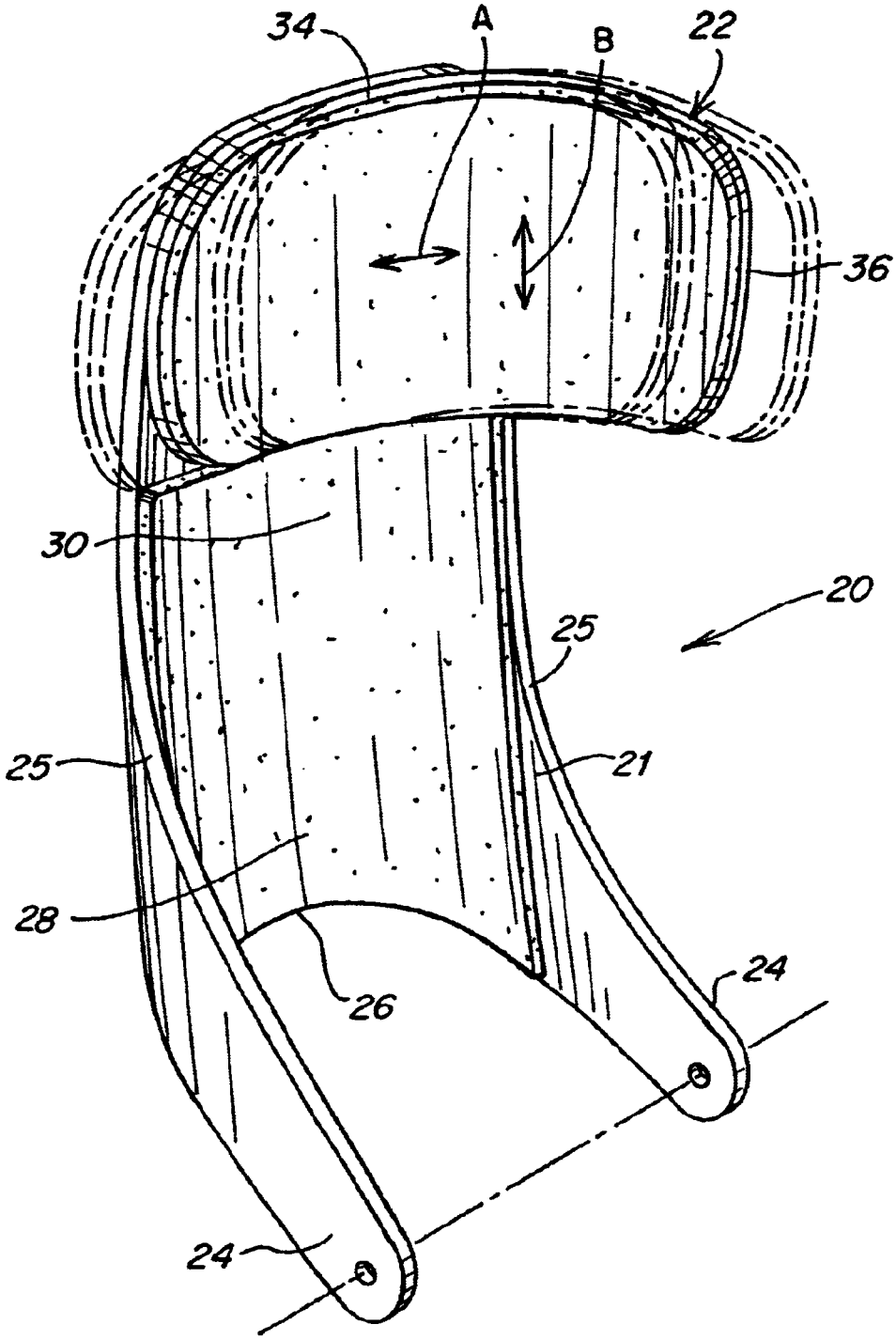
FIG. 1 is a perspective view of the highback with wing-shaped leg support members according to one illustrative embodiment of the invention.

In one illustrative embodiment as shown in FIG. 1, the highback 20 includes a body 21 and a wing-shaped leg support 22 adjustably mounted to the body 21. The support 22 cooperates with the rider's leg (not shown) to transmit rider-induced forces from the rider's leg to the highback body 21. The highback body 21 may be attached to a snowboard component, such as a snowboard binding or a snowboard boot, as will be described below. The highback body 21 includes a heel cup 26 formed at a lower portion 28 thereof that is configured to contact the heel portion of the boot. An upper portion 30 of the highback body 21 is configured to extend relative to the rear portion of the rider's leg to provide heel-side support for turning and controlling the board. At least the upper portion 30 has a contoured configuration that is generally compatible with the shape of a portion of the rider's leg or the boot.

The wing-shaped leg support 22 may be adjustably mounted to the upper portion 30 of the highback body 21, although the support may be mounted to other suitable portions of the highback body 21. The position of the support 22 relative to the highback body 21 may be selected by the rider to provide desired support and/or force transmission. In one embodiment, the support 22 is mounted for lateral movement along arrow "A" between a plurality of positions relative to the highback body 21 (two of the positions are shown in phantom). Lateral movement of the support 22 along arrow "A" may either be linear movement, where the support 22 is adapted for translation in a side-to-side direction relative to the highback body 21, or angular movement, where the support 22 is adapted for rotation about a longitudinal axis of the highback body 21. It is to be appreciated that the support 22 may be mounted for a combination of linear or angular movement.

The wing-shaped leg support 22 may be adjustably mounted to the highback 21 to accommodate a range of positions, whether linear or angular, that provides the rider with a desired support. In one embodiment, the support 22 may be mounted to the highback body 21 such that the support 22 extends beyond 90° relative to a plane extending perpendicular to the spine of the highback body 21. In another embodiment, the support 22 may extend up to 180° or more. In yet another embodiment, the support 22 may be adjustable in a range extending from about 15° to about 180°. Other suitable ranges will be readily appreciated by those of skill.

In another embodiment, the wing-shaped leg support 22 is mounted to the highback body 21 for vertical movement along arrow "B" between a plurality of vertical positions relative to the highback body 21. Alternatively, the support 22 may be mounted to the highback body 21 for both lateral and vertical movement along arrow "A" and along arrow "B", respectively. The support 22 may also be configured with a height that may encompass a portion of the height of the highback body 21, substantially the entire height of the highback body 21 or a suitable height therebetween.

It is to be appreciated that the support 22 may be mounted to the highback to accommodate other suitable adjustments. For example, the support may be adjustably mounted to the highback such that it may move toward or away from the highback. In addition, the support may be adjustably mounted to the highback such that support may be positively or negatively inclined in one or more planes relative to the highback. Other suitable mounting positions will be readily appreciated by those of skill.

Figure 1A:
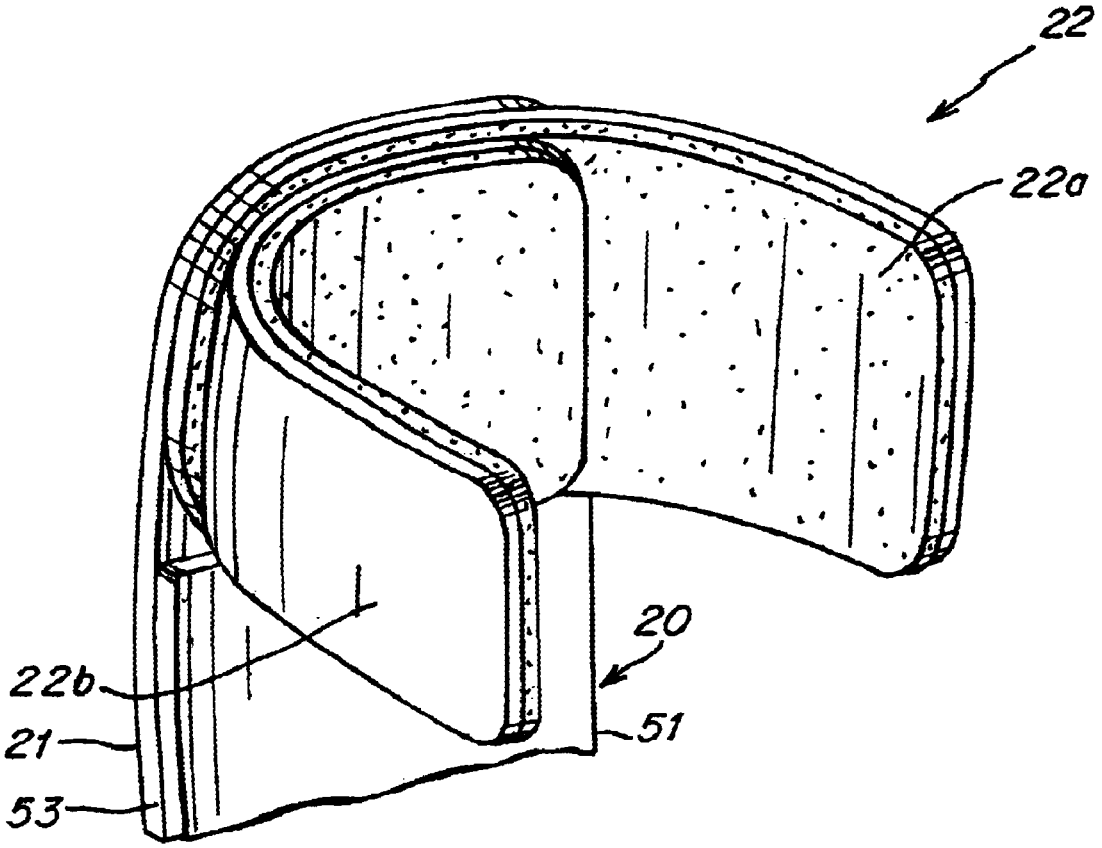
FIG. 1A is a perspective view of a portion of the highback with two wing-shaped leg support members attached thereto.

The wing-shaped leg support 22 includes a body portion 34 and a wing portion 36 extending therefrom. The body portion 34 may be mounted to the highback body 21 such that the wing portion 36 may extend from either lateral side of the highback body 21 to accommodate particular rider preferences or riding styles. In addition, as shown in FIG. 1A, the highback 20 may include two wing-shaped leg supports 22*a*, 22*b*; one support, 22*a*, extending from one lateral side 51 of the highback body 21 and the other support, 22*b*, extending from the opposite lateral side 53 of the highback body 21. Each support may be independently mounted to and adjustable relative to the highback body 21. Alternatively, a single wing-shaped leg support having two laterally extending and opposing wing portions may be mounted to the highback body 21.

Such selectable adjustment allows a rider to place the support 22 in a suitable position to accommodate boot shape, rider ability and many riding styles and situations. In one example, the support 22 may extend further away from the lateral side of the highback body 21 when larger boots are employed than may be the case when smaller boots are employed. In addition, the support 22 may be positioned higher on the highback body 21 when taller boots are employed than may be the case when lower boots are employed.

In some instances, a rider may select an aggressive stance angle, (i.e., approaching 45° or more). However, the lateral rotation of the highback 20 may be limited to a range between 0° and about 20° or may not be mounted for lateral rotation at all. In such situations, it may not be possible to align the highback 20 with the heel-edge of the board. The support 22, therefore, may be positioned on the highback body 21 in a suitable position to compensate for the limited range of lateral rotation of the highback. In this manner, the combined wing-shaped leg support 22 and highback body 21 may be suitably aligned with the heel-edge of the board so that desired rider-induced forces may be transmitted to the board.

The wing-shaped leg support 22 may also be employed to enhance force transmission in other directions, which may be preferable in certain riding conditions. For example, when riding in deep powder, such as in backcountry riding, the rider may desire to lean toward the tail of the board to prevent the tip of the board from digging into the powder. When free-carving, the rider may desire to lean toward the tip of the board to drive the tip and effect desired turning. Also, to change the turning radius of the board, the rider may desire to apply opposing sideways forces, for example, by pressing his of her knees toward or away from each other. Applying a force in this manner tends to cause the arc of the board relative to the terrain to change, thereby causing a change in the turning radius. The support 22, therefore, may be positioned on the highback body 21 in any rider selectable position suitable for providing support and desired force transmission in the above-noted and other rider preferences.

The wing-shaped leg support 22 may have a contoured configuration that is generally compatible with and conforms to a portion of the rider's leg or boot to reduce pressure points and increase board response. In one illustrative embodiment, the support 22 is generally arcuately shaped and may extend to a suitable position to accommodate a desired support. Thus, in one embodiment, the support 22 may extend along an arc that is greater than 90° relative to a plane extending perpendicular to the spine of the highback body 21 when mounted thereto. In another embodiment, the support 22 may extend along an arc that approaches 180° or more. In yet another embodiment, the support 22 may extend along an arc that is between about 15° and about 180°. Other suitable arc ranges will be readily appreciated by those of skill, although other suitable shapes may be employed. In one such example, the wing portion of the wing-shaped leg support may be flat yet mounted so as to contact at least a portion of the side of the rider's leg or boot or may have a slight curve.

Although the wing-shaped leg support shown and described has a fixed shape, the present invention is not limited in this respect and that an adjustable shape support may be employed. Suitable arrangements for adjusting the shape of the support will be readily appreciated by those of skill. In one example, the support may include two or more components where a first component is fixed to the highback, whether adjustable relative thereto or not, and a second component is movable relative to the first component, such as, for example, in a telescoping fashion. Additional components may be movably mounted to the second component also in a telescoping fashion. As one component moves relative to the other, the shape of the support may be altered.

Figure 2:
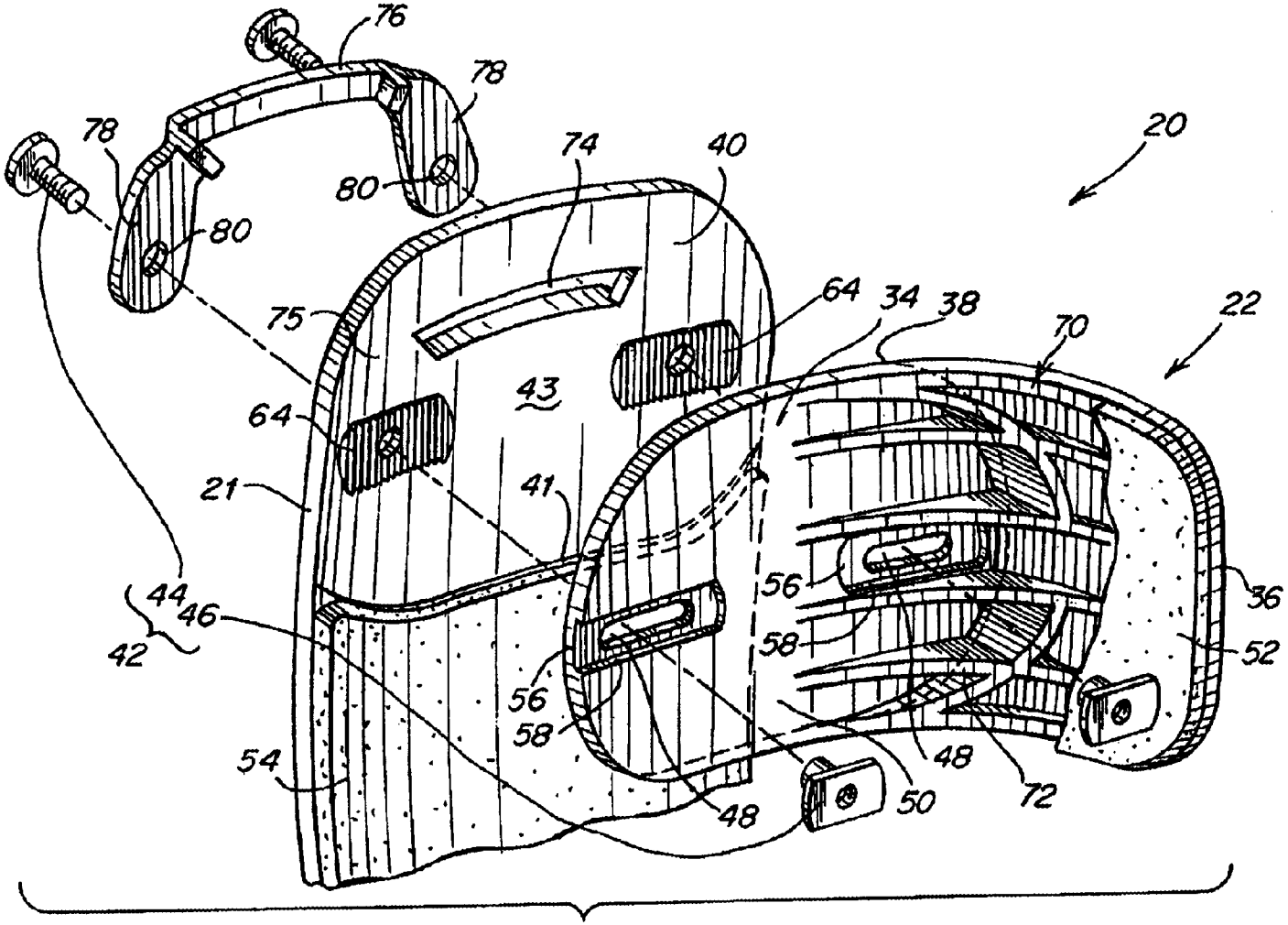
FIG. 2 is an exploded perspective view of a portion of the highback of FIG. 1.
Figure 3:
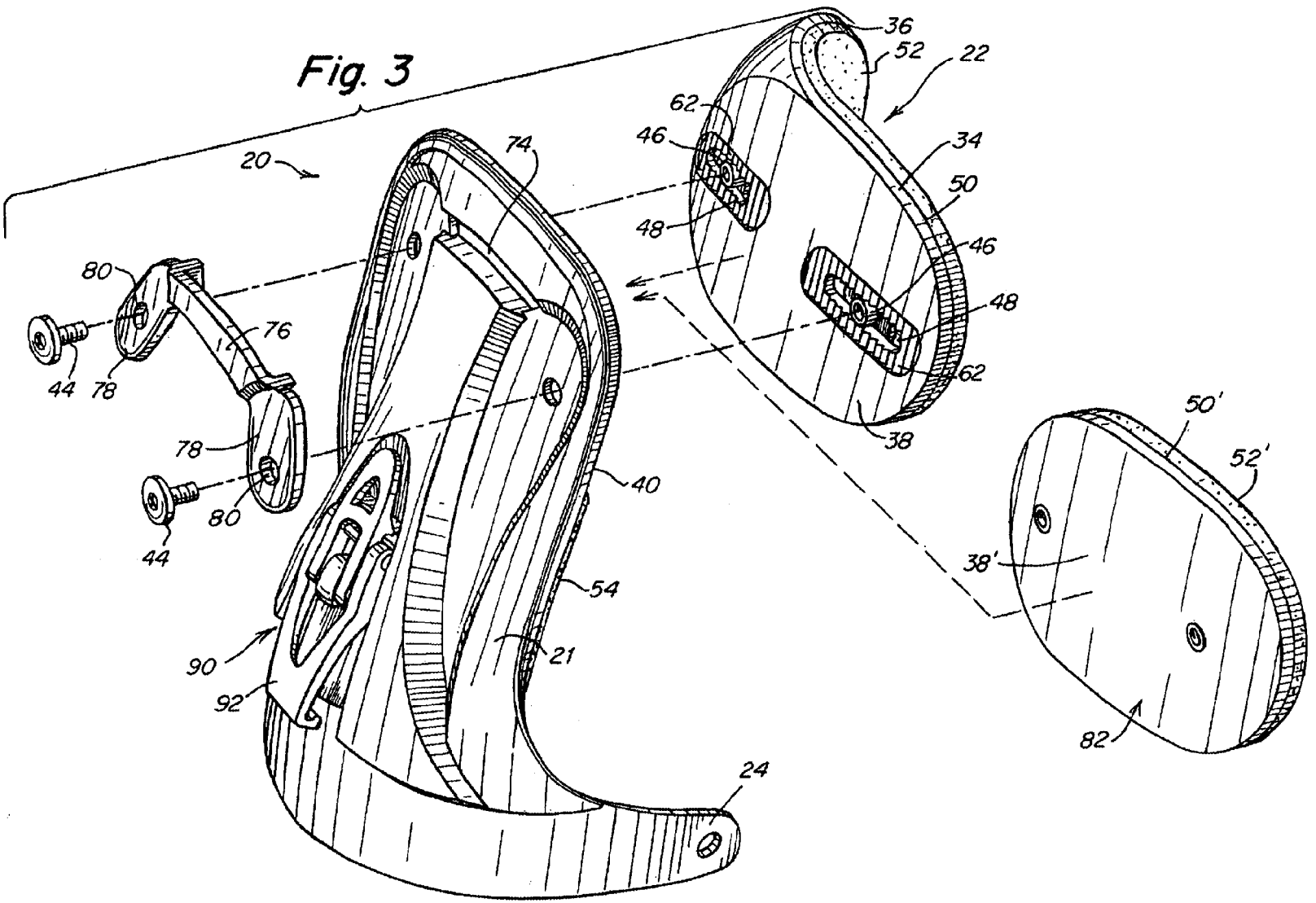
FIG. 3 is an exploded perspective rear view of the highback of FIG. 1.

To facilitate nested mounting of the support 22 to the highback body 21, in one embodiment best shown in FIGS. 2 and 3, the body portion 34 of the support 22 includes a mounting surface 38 configured to conform to an inner facing surface 40 of the highback body 21. For example, the inner surface 40 of the highback body 21 may include a generally concave shape and the mounting surface 38 of the body portion 34 may include a generally convex shape. Alternatively, the mounting surface 38 may be flat or may have a slight curve. In such embodiments, the arc of the wing portion 36 may extend into the mounting surface 38.

Although the support 22 is shown and described as being nested with the highback such that the mounting surface 38 nests with the inner facing surface 40, the present invention is not limited in this respect and that other suitable mounting arrangements may be employed. For example, the support may be adjustably mounted to the highback such that the support mounts to the outer facing surface of the highback. Alternatively, the highback may be configured with a pocket or other suitable arrangement that allows the support to be mounted within the highback.

As best shown in FIG. 2, the highback body 21 may include a lip 41 that defines a mounting area 43 on the highback body 21 to which the support 22 is mounted. The lip 41 also may be suitably arranged on the highback body 21 to cooperate with the support to inhibit downward movement of the support relative to the highback. The mounting area 43 may be recessed relative to the remainder of the highback body 21. Thus, the support 22 may be mounted to the highback body 21 in a manner that provides a substantially flush transition between the inner facing surface of the highback body and the inner facing surface of the support 22.

The support 22 may be mounted to the highback body 21 with at least one and preferably at least two fasteners 42. In one illustrative embodiment, each fastener 42 includes a screw 44 and a "T" nut 46. However, it is to be appreciated that the present invention is not limited in this respect and that other suitable fasteners or fastening means may be employed. For example, a tool-free fastener may be employed. One example of such a tool-free fastener is a cam-actuated quick-release fastener. Those of skill in the art will readily appreciate other suitable fasteners that allow the rider to adjust the position of the support 22 relative to the highback body 21.

To facilitate adjustably mounting the support 22 to the highback body 21, the support 22 may include a plurality of attachment points. In the illustrative embodiment shown in FIGS. 2 and 3, mounting slots 48 may be employed to provide such a plurality of attachment points. In this embodiment, the slots 48 extend in a lateral direction relative to the highback body 21 such that the support 22 may be adjustably moved along arrow "A" (see FIG. 1). Specifically, the slots 48 allow movement along either a linear direction or an angular direction, as described above.

Figure 3A:
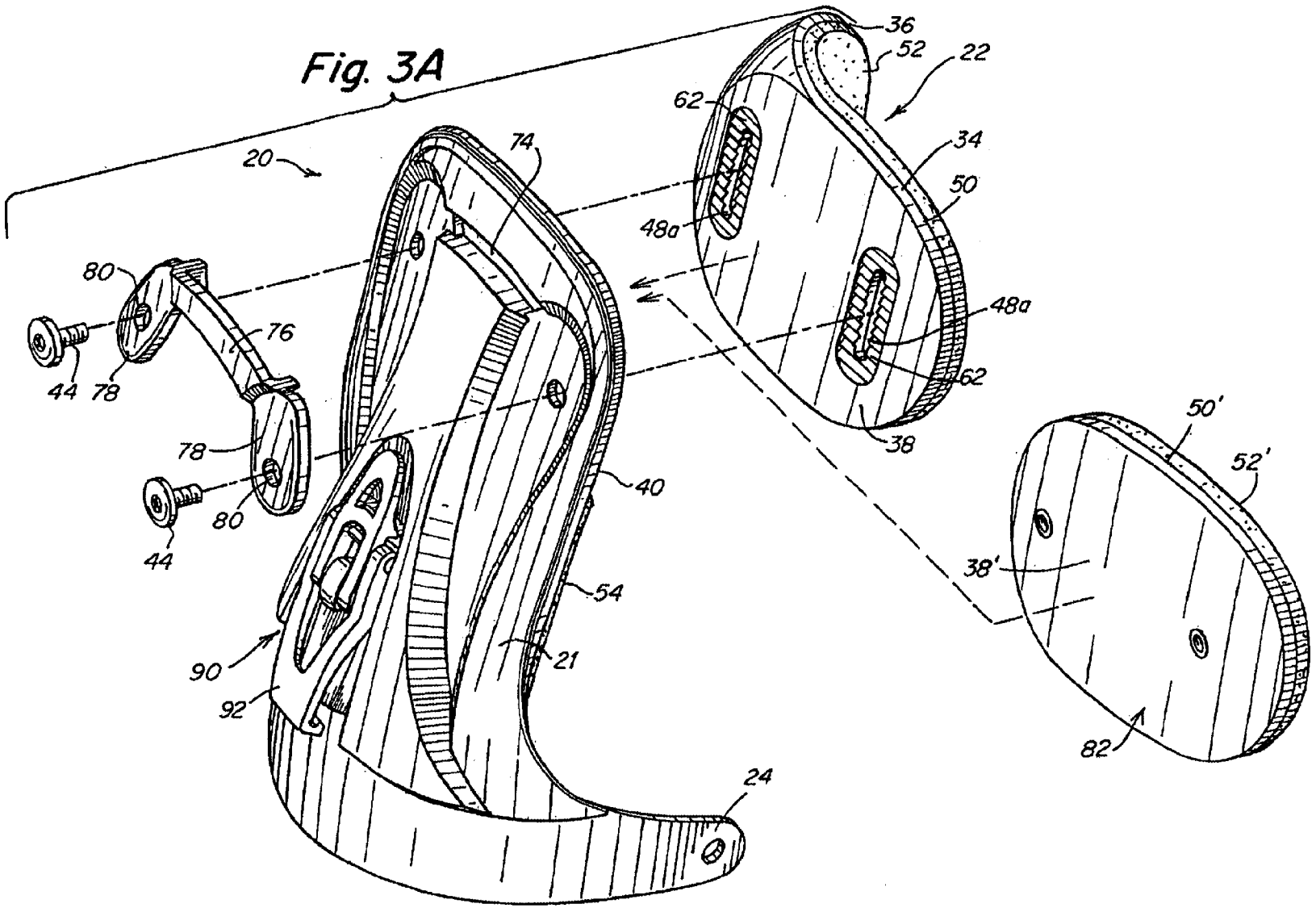
FIG. 3A is a perspective view of an alternative embodiment of the wing-shaped leg support member.

Also as described above, the support 22 may be mounted for movement in a vertical direction. In this arrangement, as shown in FIG. 3A, one or more vertically extending slots 48*a* may be formed in the body portion 34 to facilitate such vertical movement. Of course, one or more slots may extend along an arc or in other suitable directions to facilitate movement in any desired direction.

It is to be appreciated that other suitable mounting arrangements may be employed for adjustably mounting the support 22 to the highback body 21. For example, multiple sets of laterally extending and vertically spaced slots may be employed such that a given set of slots selectively fixes the vertical position and the support is laterally adjustable within this set of slots. Alternatively, multiple sets of vertically extending and laterally spaced slots may be employed such that a given set of slots selectively fixes the lateral position and the support is vertically adjustable within this set of slots. In another example, a series of holes formed in a suitable hole pattern may be employed. The hole pattern may be sufficient to allow movement in any desired direction.

Figure 2A:
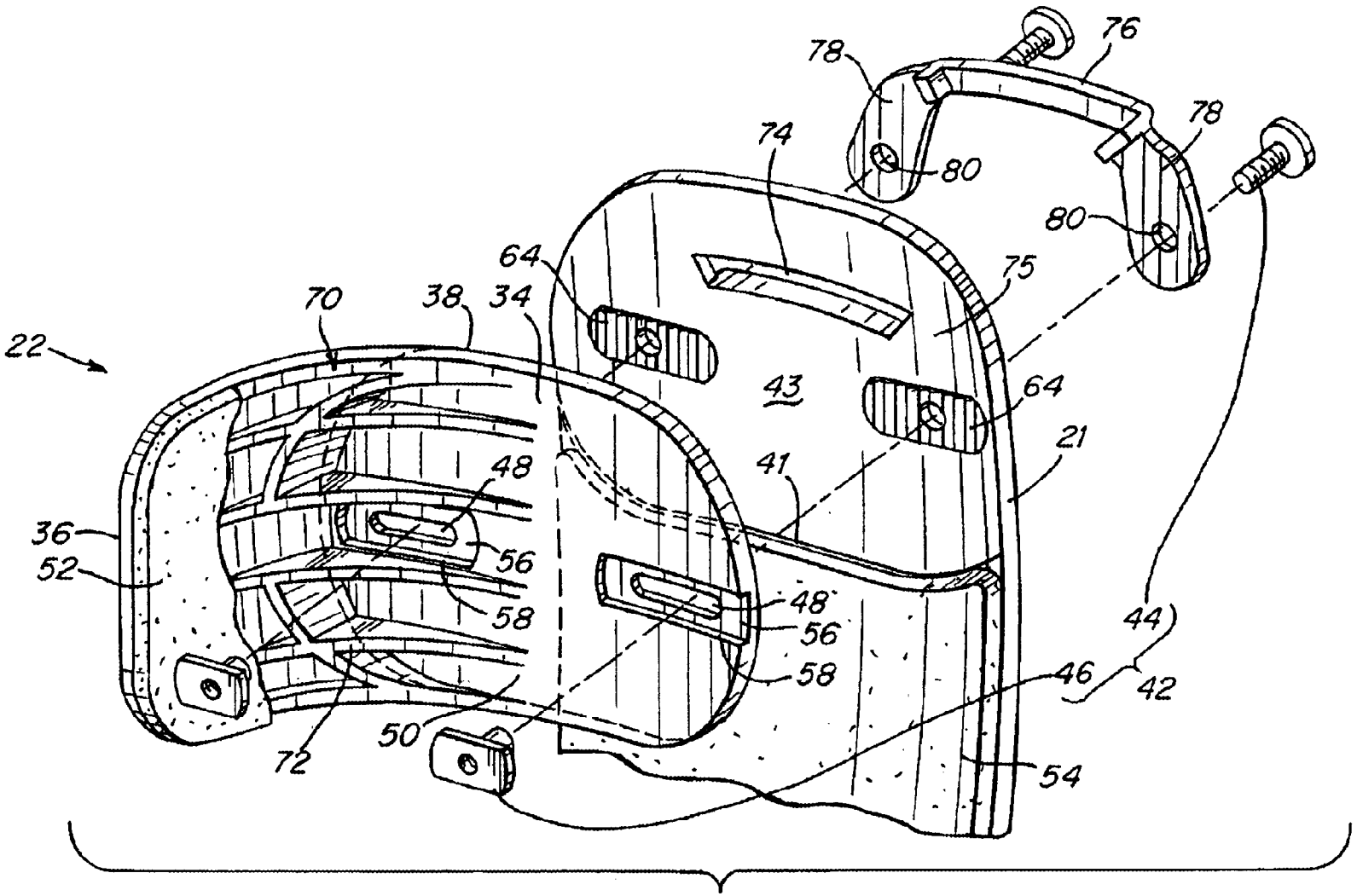
FIG. 2A is an exploded perspective view of a portion of the highback of FIG. 2 with a winged shaped leg support member mounted in an alternate position.

As discussed above, the support 22 may extend from either lateral side of the highback body 21. In the example shown in FIGS. 2, 2A, and 3, the slots 48 are formed along a midline of the support and are also disposed symmetrically about a vertical axis of the body portion 34 of the support 22. In this manner, the support 22 may be mounted as shown in FIG. 2 or may be flipped over 180° to be mounted so as to extend from the opposite lateral side of the highback body 21 as shown in FIG. 2A. Symmetrically arranging the slots 48 in this manner allows the rider to easily adjust the support.

The slots or other shaped hole may be positioned on the vertical axis of the body portion 34 such that the support 22 may be mounted to the center of the highback body 21. In this manner, the support 22 may be selectively mounted to the highback body 21 so as to extend from either side thereof.

Although the slots 48 are formed in a symmetrical pattern, the present invention is not limited in this respect and that other suitable positions for the slots 48 may be employed. For example, the slots 48 may be formed above or below the midline such that the support may be positioned vertically higher or lower on the highback body 21 depending upon which side of the highback body 21 the support 22 is mounted. In addition, although the slots 48 are formed in the support 22, the present invention is not limited in this respect and the slots 48, or any other suitable mounting arrangement, may be formed in the highback body 21.

Figure 4:
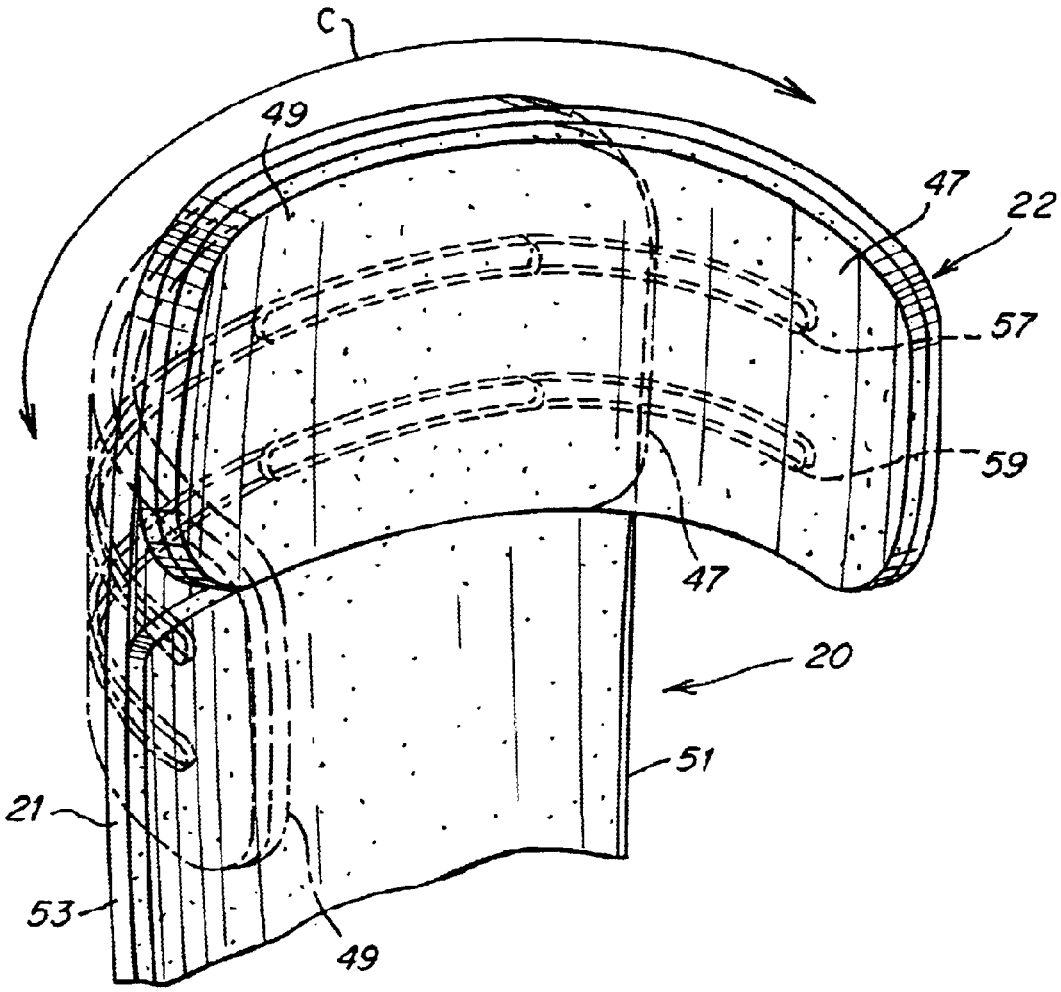
FIG. 4 is a perspective view of a wing-shaped leg support according to another aspect of the invention.

In one embodiment, the wing-shaped leg support 22 includes additional attachment points so that the support may laterally slide relative to the highback body 21. Thus, the portion of the support 22 that previously mounted the support 22 to the highback body 21 now laterally extends from the highback body 21 and the portion of the support 22 that previously laterally extended from the highback body 21 now mounts the support 22 to the highback body 21. In one illustrative embodiment, as shown in FIG. 4, the support 22 may include a first portion 47 that is configured to extend from a first lateral side 49 of the highback and a second portion 51 that is configured to mount the highback body 21. As shown in phantom, the support 22 may slide along arrow "C" relative to the highback body 21 such that the first portion 47 may now mount the support 22 to the highback body 21 and the second portion may extend from a second lateral side 53 of the highback body 21. Slots 57 and 59 may be employed to provide the additional attachment points and may extend between the first and second portions 47, 49 to accommodate such lateral sliding.

It is to be appreciated that the support 22 may be mounted in any suitable position relative to the highback. For example, the support may be centrally mounted to the highback such that the first portion 47 at least partially extends from the first lateral side 49 of the highback body 21 and the second position 51 at least partially extends from the second lateral side 53 of the highback body 21, thereby providing a wing portion on both lateral sides of the highback body 21.

A pad may be employed to add comfort for the rider as well as provide a relatively higher friction surface with which a rider may efficiently transmit forces to the support 22. In this respect, the pad serves to grip and hold a portion of the rider's boot. Thus, continuing with reference to FIGS. 2 and 3, the inner surface 50 of the support 22 includes a pad 52 adhered thereto. The inner surface 40 of the highback body 21 may also include one or more resilient pads 54 to increase heel hold, to absorb shock and to facilitate pressure distribution across the boot and leg.

It is to be appreciated, however, that other suitable arrangements may be employed for increasing rider comfort and grip. For example, in one embodiment, the support 22 may be formed of plastic material with a comfort zone integrally molded into the support utilizing conventional plastic forming techniques such as injection molding. In addition, a roughened surface for enhanced gripping may be formed on the inner surface 50 of the support 22.

The support 22 may include a suitable arrangement for holding at least a portion of the fastener to facilitate securing the fastener. Thus, in one illustrative embodiment shown in FIG. 2, the support 22 may include a recess 56 formed about the mounting slots 48 and shaped to hold a portion of the fastener, such as the "T" nut 46. In this manner, sidewalls 58 of the recess 56 engage the "T" nut 46 to prevent rotation of the "T" nut 46 as the screw 44 is rotated to secure the fastener. The recess 56 also may serve to reduce discomfort when utilizing the support by preventing the fastener from protruding into the space occupied by the rider's boot. Although the support, as shown, includes such a recess, it is to be appreciated that the present invention is not limited in this respect and that other suitable mounting arrangements may be employed.

To enhance securing the support 22 to the highback body 21, the support 22 may be formed with a plurality of teeth 62 (see FIG. 3) configured to engage a corresponding plurality of teeth 64 formed on the highback body 21 (see FIG. 2). The teeth may be integrally molded into the support and/or the highback body 21. It should be appreciated that the present invention is not limited in this respect and that other suitable arrangements for limiting movement of the support 22 relative to the highback body 21 may be utilized. For example, the support 22 (or highback body 21) include a plurality of pins that engage a plurality of mating recesses formed in the highback body 21 (or support 22). Alternatively, the mating surface 38 of the support 22 and/or the inner surface 40 of the highback body 21 may include a roughened surface.

The efficiency of force transmission is a function of the rigidity or stiffness of the support acted upon by the rider. Thus, continuing with reference to FIGS. 2 and 3, the support 22 may include a reinforced section 70 formed at the junction between the body portion 34 and the wing portion 36. This reinforced section 70 increases the rigidity of the support 22 such that when the rider-induced forces are applied to the support 22, deflection of the support 22 is reduced and the efficiency in force transfer is increased. In one illustrative embodiment, the reinforced section 70 includes a plurality of reinforcing ribs 72 that may be molded into the support 22. In another embodiment, the reinforced section may be configured as a thickened section. Alternatively, to increase the stiffness of the wing portion 36, the wing portion 36 may have a thickness that is greater than a thickness of the body portion 34.

It should be appreciated, however, that the reinforcing section 70 need not be employed. In this respect, the support 22 may be formed of a material other than plastic that has the desired rigidity. For example, the support may be formed of metal, in which case the reinforcing section need not be included or may be reduced in size.

The highback may be configured to provide the rider with the ability to alter the stiffness of the highback for comfort and for control. In one embodiment, the highback body 21 may include an aperture 74 formed therein to form a flex zone 75 thereabout. The aperture 74 is generally slot-shaped, although any suitably configured aperture may be employed to achieve the desired flexibility characteristics of the highback body 21. An interchangeable flex control element may be employed to at least partially fill the aperture 74 to increase the stiffness of the highback to a desired level. An example of such an adjustable stiffness highback is described in co-pending U.S. patent application Ser. No. 09/169,074, which is commonly assigned to the Burton Corporation and which is incorporated herein by reference. It is to be appreciated, however, that changes to highback flexibility may be implemented by any other suitable manner apparent to one of skill in the art. For example, rather than or in addition to apertures, the flexibility of the highback may be increased or decreased by varying the thickness of the highback at selected locations.

As stated above, because the efficiency of force transfer is a function of support stiffness, it may be desirable to employ the support 22 with a relatively stiff highback body 21. Thus, when the highback body 21 includes a flex zone 75, such as described above, the support 22 may be configured to reduce the effects of the flex zone and thereby increase the stiffness of the highback body 21. In one illustrative embodiment, the support 22 may include a flex control element 76 that at least partially fills the aperture 74 so as to increase the rigidity of the highback.

The flex control element 76, as shown in FIGS. 2 and 3, may also include mounting tabs 78 having holes 80 to receive the fasteners 42 so that the flex control element 76 may be held to the highback body 21. Those of skill will readily appreciate other suitable mounting arrangements.

Although a separate flex control element is shown and described, it is to be appreciated that the flex control element may be formed in the body portion 34 of the support 22. For example, the flex control element may be formed on the mounting surface 38 of the support 22 such that, when the support 22 is mounted to the highback body 21, the flex control element at least partially fills the aperture 74.

In one illustrative embodiment of the invention, a plurality of interchangeable leg supports, each having a unique shape suitable for a particular riding preference and each being mountable to the highback body 21, is provided. The rider may therefore select a suitably shaped leg support for a particular riding preference and mount the support to the highback body 21. Should a rider wish to remove the support from the highback, a filler member 82, as shown in FIG. 3, may be interchanged with the support 22. The filler member 82 may include a suitable mounting surface 38' and a pad 56' adhered to the inner surface 54'.

A snowboard rider's legs are generally held by the highback at a forward angle relative to the board for balance, control and to ensure the rider's knees are bent for better shock absorption, particularly when landing jumps. To hold the rider's legs in such a stance, the highback is typically inclined relative to the board in a position referred to as "forward lean". The highback may be mounted to the snowboard component for rotation in the heel-to-toe direction and therefore the rider may selectively adjust the forward lean angle of the highback relative to the board for comfort, control and the rider's particular riding style. In one illustrative embodiment, the forward lean may be adjusted using a suitable forward lean adjuster 90.

To further enhance force transmission to the board, the highback may be locked to the snowboard component to limit twisting of the highback relative to the component. Such a locked configuration may be accomplished using a forward lean lock. For example, the forward lean adjuster 90 may include a latch 92 to releasably secure the highback 20 to the component. The latch may be configured as a hook, a bail, or another suitable arrangement to secure the highback to the component. One example of a suitable lock is described in co-pending U.S. patent application Ser. No. 08/780,722, now U.S. Pat. No. 6,027,136, which is commonly owned by The Burton Corporation and which is incorporated herein by reference. It is to be appreciated that other suitable arrangements to lock the highback 20 to the component to limit twisting may be employed. Such locking arrangements may be positioned at any suitable location on the highback or the component or both.

Figure 5:
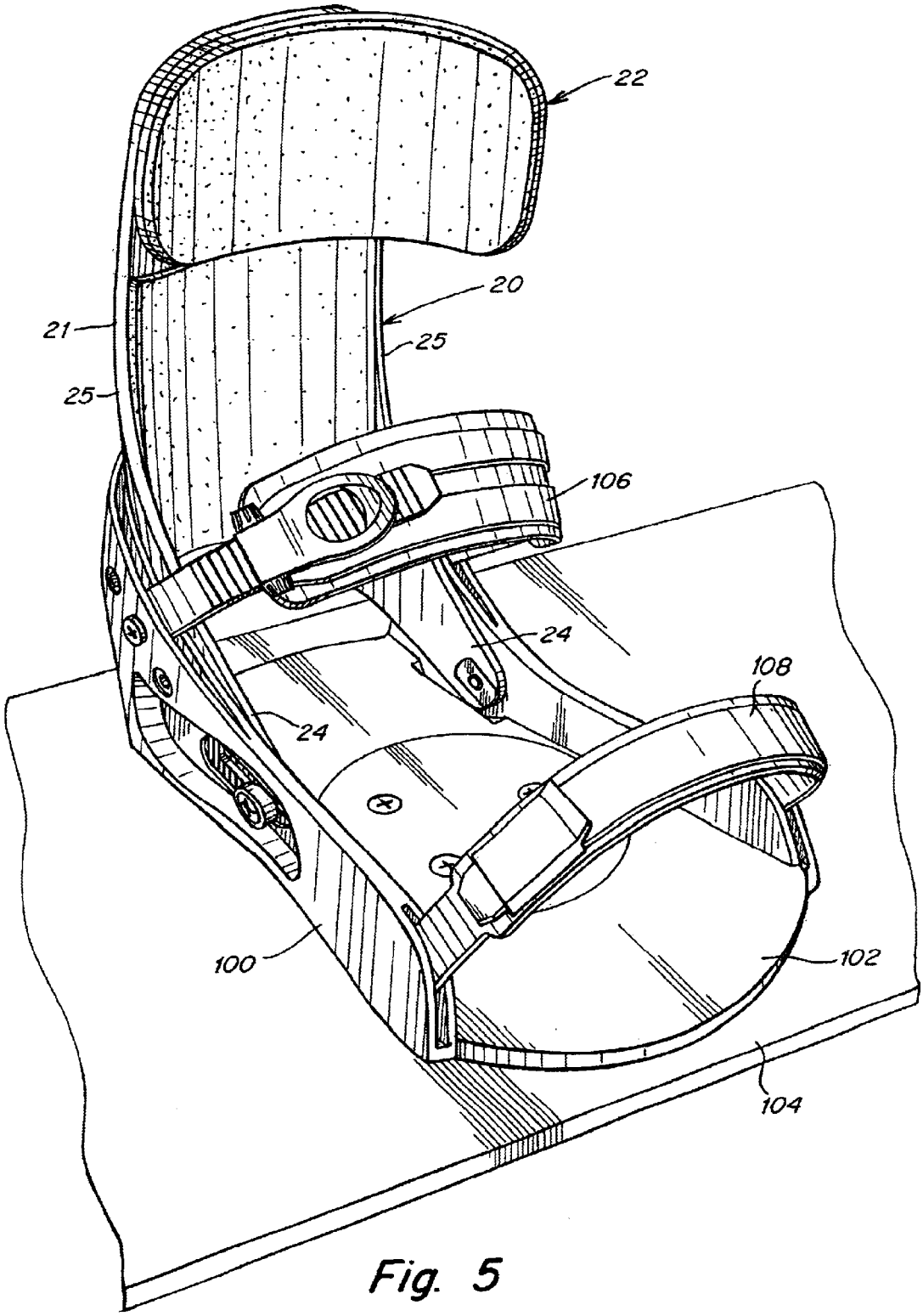
FIG. 5 is a perspective view of the highback incorporated with an illustrative embodiment of a snowboard binding according to another aspect of the invention.

The highback 20 may be mounted to any suitable snowboard component, such as a binding or a boot, in a manner to facilitate board control. In one illustrative embodiment, as shown in FIG. 5, the highback is mounted to a binding 100. The binding includes a baseplate 102, which is mountable to a snowboard 104, and one or more binding straps, preferably adjustable straps, that are attached to the baseplate 102 for securing a boot (not shown) to the snowboard 104. Lateral arms 24 that extend from opposing lateral sides 25 of the highback are pivotally mounted to the sidewalls of the baseplate 102 for lateral rotation and/or forward lean, although other suitable arrangements for attaching the highback 20 to the baseplate, whether allowing lateral rotation and/or forward lean or not, may be employed. As illustrated, the binding 100 may include an ankle strap 106 that extends across the ankle portion of the boot to hold down the rider's heel and a toe strap 108 that extends across and holds down the front portion of the boot. It is to be understood, however, that the binding 100 may implement other strap configurations.

The highback 20 of the present invention, however, is not limited to any particular type of binding. For example, the highback may also be implemented with a step-in snowboard binding that includes a locking mechanism that engages corresponding features provided, either directly or indirectly, on a snowboard boot. The highback may be mounted to a binding baseplate in a manner similar to the binding described above.

Figure 6:
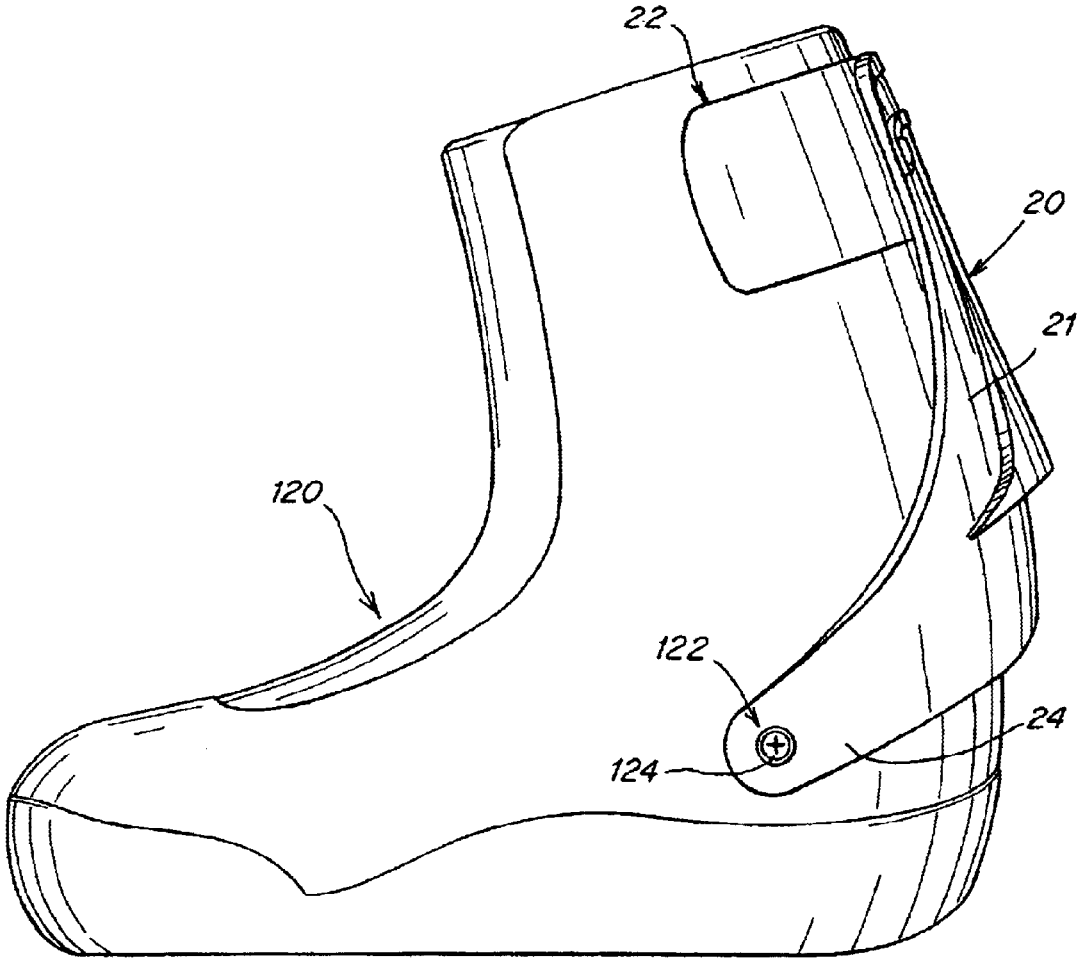
FIG. 6 is a side view of the highback incorporated with an illustrative embodiment of a snowboard boot according to a further aspect of the invention.

In another embodiment, the highback 20 is mounted to a snowboard boot. As illustrated in FIG. 6, the highback 20 is mounted to the heel region of a boot 120. The lateral arms 24 are preferably attached below the ankle portion of the boot 120 for facilitating lateral rotation and/or forward lean, although other suitable arrangements for attaching the highback to the boot, whether allowing lateral rotation and/or forward lean or not, may be employed. The lateral arms 24 may be attached to the boot 120, preferably at reinforced attachment points 122, using any suitable fastener 124, such as a screw, rivet or the like, that passes through each lateral arm.

Figure 7:
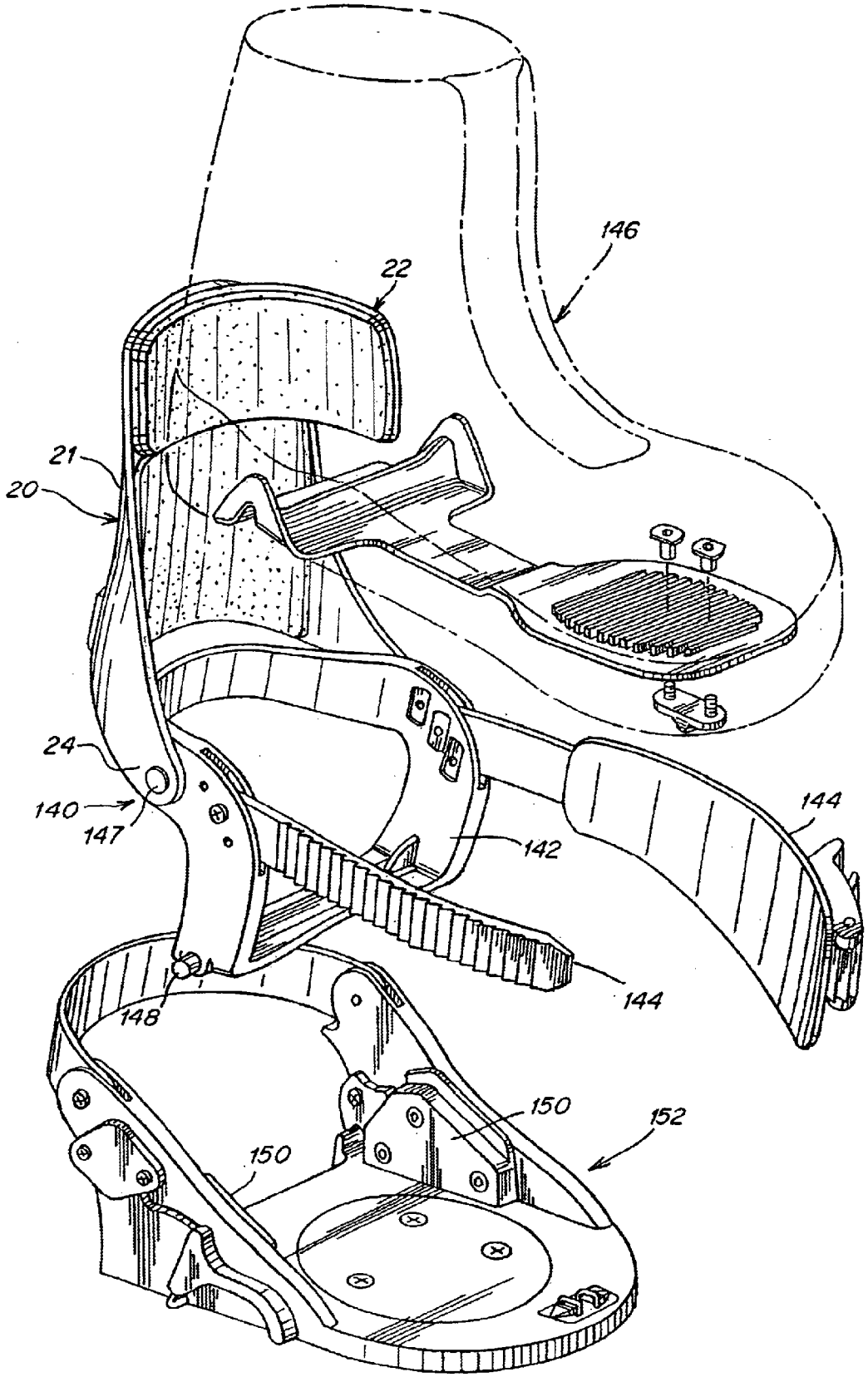
FIG. 7 is a perspective view of the highback incorporated with an illustrative embodiment of a detachable binding interface according to another aspect of the invention.

In another embodiment, the highback is mounted to a detachable binding interface for interfacing a boot to a binding. As illustrated in the embodiment shown in FIG. 7, the interface 140 includes a body 142 and at least one adjustable strap 144 that is arranged to be disposed across the ankle portion of the boot 146, which is shown in phantom. The highback 20 is mounted to the sidewalls of the interface body 142 using a suitable fastener 147 that passes through the lateral arms 24 of the highback, although other suitable arrangements for attaching the highback to the binding interface, whether allowing lateral rotation and/or forward lean or not, may be employed. The body 142 of the interface may include one or more mating features 148, as would be apparent to one of skill in the art, that are adapted to engage corresponding engagement members 150 on the binding 152. An example of such a binding interface 140 and binding 152 is described in greater detail in a U.S. application Ser. No. 09/062,131, which is commonly owned by The Burton Corporation and which is incorporated herein by reference.

For ease of understanding, and without limiting the scope of the invention, the inventive highback with wing-shaped leg support to which this patent is addressed is discussed particularly in connection with a boot or binding that is used in conjunction with a snowboard. It should be appreciated, however, that the present invention may be used in association with other types of gliding boards. Thus, for purposes of this patent, "gliding board" refers generally to specially configured boards for gliding along a terrain such as snowboards, snow skis, water skis, wake boards, surf boards and other board-type devices which allow a rider to traverse a surface.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and their equivalents.

What is claimed is:

1. An apparatus comprising:

a highback for use with a component that interfaces with a rider's leg and is supportable by a gliding board, the highback being constructed and arranged to be mounted to the component and to be contacted by a rear portion of the rider's leg; and a wing-shaped leg support extending in a lateral direction from the highback, the support being constructed and arranged to cooperate with the rider's leg to transmit forces from the rider's leg to the highback, the support being adjustably movable between a plurality of positions relative to the highback so that the position of the support relative to the highback may be selectively adjusted by the rider;

wherein the support is also adapted to be selectively mountable to the highback by the rider in one of a first adjustable position whereby the support extends from a first lateral side of the highback, and in a second adjustable, flipped over position whereby the support extends from an opposite, second lateral side of the highback.

2. The apparatus according to claim 1, wherein the plurality of positions includes at least one of a plurality of linear positions and a plurality of angular positions.

3. The apparatus according to claim 1, wherein the support includes at least one slot formed therein to facilitate adjustable mounting of the support to the highback.

4. The apparatus according to claim 3, wherein the at least one slot is formed along a midline of the support.

5. The apparatus according to claim 4, wherein the at least one slot comprises two slots, and wherein the slots are disposed symmetrically about a vertical axis of a body portion of the support.

6. The apparatus according to claim 1, wherein the support is shaped to conform to a portion of the rider's leg.

7. The apparatus according to claim 1, wherein the support is arcuately shaped.

8. The apparatus according to claim 1, wherein the support is elongated in a lateral direction.

9. The apparatus according to claim 1, wherein the support includes a plurality of teeth matingly engaging the highback to maintain the support in one of the plurality of positions.

10. The apparatus according to claim 9, wherein the highback includes a plurality of teeth matingly engaging with the plurality of teeth of the support.

11. The apparatus according to claim 1, wherein the highback includes an inner surface facing toward the support, the inner surface having a generally concave shape, and wherein the support includes a mounting surface having a shape conforming with the generally concave shape of the inner surface of the highback.

12. The apparatus according to claim 1, wherein the support includes an inner surface facing away from the highback, the support including a pad mounted to at least a portion of the inner surface thereof.

13. The apparatus according to claim 1, further including a forward lean adjuster mounted on the highback and constructed and arranged to cooperate with the component to selectively position the highback in one of a plurality of positions relative to the component.

14. The apparatus according to claim 13, wherein the forward lean adjuster includes a forward lean lock constructed and arranged to lock the highback to the component.

15. The apparatus according to claim 1, in combination with the component, wherein the highback is mounted to the component.

16. The combination according to claim 15, wherein the highback is pivotally mounted to the component.

17. The combination according to claim 16, wherein the highback is selectively positionable in one of a plurality of forward lean positions relative to the component.

18. The combination according to claim 16, wherein the highback is lockable to the component to inhibit twisting of the highback relative to the component.

19. The combination according to claim 15, wherein the component is a snowboard binding.

20. The combination according to claim 15, wherein the component is a snowboard boot.

21. The combination according to claim 15, wherein the component is a detachable binding interface that is constructed and arranged to interface a snowboard boot with a snowboard binding.

22. The highback according to claim 1, wherein the leg support is movable between a plurality of lateral positions.

23. The highback according to claim 1, wherein the leg support is movable between a plurality of vertical positions.

24. A system for use with a component that interfaces with a rider's leg and is supportable by a gliding board, the system comprising:

a highback constructed and arranged to mount to the component and to be contacted by a rear portion of the rider's leg; and a plurality of interchangeable leg supports, each support constructed and arranged to be mounted to the highback and to laterally extend from the highback, each support constructed and arranged to cooperate with the rider's leg to transmit forces from the rider's leg to the highback, wherein at least one support is constructed and arranged to be movably mounted to the highback between a plurality of positions relative to the highback so that a position of the support relative to the highback is selectively adjustable by the rider.

25. The system according to claim 24, wherein the plurality of positions includes at least one of a plurality of linear positions and a plurality of angular positions.

26. The system according to claim 24, wherein the plurality of positions includes a first lateral position, wherein the support extends from a first lateral side of the highback, and a second lateral position, wherein the support extends from a second lateral side of the highback.

27. The system according to claim 24, wherein a first support is mountable to the highback such that the first support extends from a first lateral side of the highback when the first support is mounted thereto and wherein a second support is mountable to the highback such that the second support extends from a second lateral side of the highback when the second support is mounted thereto.

28. The system according to claim 24, wherein at least one support includes at least one slot formed therein to facilitate adjustable mounting of the at least one support to the highback.

29. The system according to claim 24, wherein each support has a unique shape.

30. The system according to claim 24, wherein at least one support is shaped to conform to a portion of the rider's leg.

31. The system according to claim 24, wherein at least one support is arcuately shaped.

32. The system according to claim 24, wherein each support is elongated in a lateral direction.

33. The system according to claim 24, wherein at least one support includes a plurality of teeth constructed and arranged to matingly engage the highback when the support is mounted to the highback to maintain the support in one of the plurality of positions.

34. The system according to claim 33, wherein the highback includes a plurality of teeth constructed and arranged to matingly engage with the plurality of teeth of the at least one support when the support is mounted to the highback.

35. The system according to claim 24, further including a filler pad that is interchangeable with the plurality of supports, the filler pad having first and second lateral sides and wherein the highback includes first and second lateral sides, the filler pad being constructed and arranged to be mounted to the highback such that the lateral sides of the filler pad are confined within the boundaries of the lateral sides of the highback.

36. The system according to claim 24, further including a forward lean adjuster mounted on the highback and constructed and arranged to cooperate with the component to selectively position the highback in one of a plurality of positions relative to the component.

37. The system according to claim 36, wherein the forward lean adjuster includes a forward lean lock constructed and arranged to lock the highback to the component.

38. The system according to claim 24, in combination with the component, wherein the highback is mounted to the component.

39. The combination according to claim 38, wherein the highback is pivotally mounted to the component.

40. The combination according to claim 39, wherein the highback is selectively positionable in one of a plurality of forward lean positions relative to the component.

41. The combination according to claim 39, wherein the highback is lockable to the component to inhibit twisting of the highback relative to the component.

42. The combination according to claim 38, wherein the highback is mounted to the component for lateral rotation relative thereto.

43. The combination according to claim 38, wherein the component is a snowboard binding.

44. The combination according to claim 38, wherein the component is a snowboard boot.

45. The combination according to claim 38, wherein the component is a detachable binding interface that is constructed and arranged to interface a snowboard boot with a snowboard binding.

46. The system according to claim 24, wherein the leg support is movable between a plurality of lateral positions.

47. The system according to claim 24, wherein the leg support is movable between a plurality of vertical positions.

48. A system for use with a component that interfaces with a rider's leg and is supportable by a gliding board, the system comprising:

a highback constructed and arranged to mount to the component and to be contacted by a rear portion of the rider's leg; and a plurality of interchangeable leg supports, each support constructed and arranged to be mounted to the highback and to laterally extend from the highback, each support constructed and arranged to cooperate with the rider's leg to transmit forces from the rider's leg to the highback, wherein the highback includes an inner surface facing toward the support when mounted thereon, the inner surface having a generally concave shape, and wherein at least one of the supports includes a mounting surface having a shape conformable with the generally concave shape of the inner surface of the highback.

49. A system for use with a component that interfaces with a rider's leg and is supportable by a gliding board, the system comprising:

a highback constructed and arranged to mount to the component and to be contacted by a rear portion of the rider's leg; and a plurality of interchangeable leg supports, each support constructed and arranged to be mounted to the highback and to laterally extend from the highback, each support constructed and arranged to cooperate with the rider's leg to transmit forces from the rider's leg to the highback, wherein at least one support includes an inner surface facing away from the highback when mounted thereon, the at least one support including a pad mounted to at least a portion of the inner surface.

50. A wing-shaped leg support for use with a highback, the highback for use with a component that interfaces with a rider's leg and is supportable by a gliding board, the support comprising:

a body portion constructed and arranged to engage with the highback, the body portion having an inner surface and an outer surface;

a wing portion disposed laterally of the body portion and extending forwardly from the body portion, the wing portion being constructed and arranged to cooperate with the rider's leg to transmit forces from the rider's leg to the highback, the wing portion having an inner surface and an outer surface, the inner surfaces of the wing and body portions defining an inner surface of the leg support and the outer surfaces of the wing and body portions defining an outer surface of the leg support, the inner and outer surfaces of the leg support defining a thickness therebetween; and a reinforced section formed between the body portion and the laterally disposed and forwardly extending wing portion, the reinforced section constructed and arranged to lie adjacent a lateral side of the highback when the leg support is mounted thereto, wherein an increase in the thickness defines at least a portion of the reinforced section.

51. The support according to claim 50, wherein the reinforced section includes a plurality of reinforcing ribs.

52. The support according to claim 50, wherein the thickness in the wing portion is greater than a thickness in the body portion.

53. The support according to claim 50, wherein the body portion includes an attachment feature that is constructed and arranged to mount the support in a plurality of positions relative to the highback so that the position of the support relative to the highback may be selectively adjusted by the rider.

54. The support according to claim 53, wherein the attachment feature is constructed and arranged to mount the support in a plurality of lateral positions relative to the highback.

55. The support according to claim 53, wherein the attachment feature is constructed and arranged to mount the support in a plurality of vertical positions relative to the highback.

56. An apparatus comprising:

a highback for use with a component that interfaces with a rider's leg and is supportable by a gliding board, the highback being constructed and arranged to be mounted to the component and to be contacted by a rear portion of the rider's leg; and a wing-shaped leg support mounted to the highback, the support comprising:

a body portion constructed and arranged to engage with the highback; and a wing portion disposed laterally of the body portion and extending forwardly from the body portion, the wing portion being constructed and arranged to cooperate with a lateral side of the rider's leg to transmit forces from the rider's leg to the highback;

wherein the support is also adapted to be selectively mountable to the highback by the rider in one of a first adjustable position whereby the support extends from a first lateral side of the highback, and in a second adjustable, flipped over position whereby the support extends from an opposite, second lateral side of the highback.

57. An apparatus comprising:

a component that interfaces with a rider's leg and is supportable by a gliding board;

a highback mounted to the component at an attachment location and extending upwardly through an upper portion to a top edge, the highback defining a height generally between the attachment location and the top edge, the highback being constructed and arranged to be contacted by a rear portion of the rider's leg; and a wing-shaped leg support extending in a lateral direction from the upper portion of the highback, the support having a wing portion that is constructed and arranged to cooperate with the rider's leg to transmit forces from the rider's leg to the highback, the support being adjustably movable between a plurality of positions relative to the highback so that the position of the support relative to the highback may be selectively adjusted by the rider, the support having a height that is less than the height of the highback, wherein the support is constructed and arranged to selectively mount to the highback in one of a first lateral position, wherein the support extends from a first lateral side of the highback, and a second lateral position, wherein the support extends from a second lateral side of the highback.

58. The apparatus according to claim 57, wherein the plurality of positions includes at least one of a plurality of linear positions and a plurality of angular positions.

59. The apparatus according to claim 57, wherein the support includes at least one slot formed therein to facilitate adjustable mounting of the support to the highback.

60. The apparatus according to claim 57, wherein the support is arcuately shaped.

61. The apparatus according to claim 59, wherein the support is elongated in a lateral direction.

62. The apparatus according to claim 57, further including a forward lean adjuster mounted on the highback and constructed and arranged to cooperate with the component to selectively position the highback in one of a plurality of positions relative to the component.

63. The apparatus according to claim 62, wherein the forward lean adjuster includes a forward lean lock constructed and arranged to lock the highback to the component.

64. The apparatus according to claim 57, wherein the highback is pivotally mounted to the component.

65. The apparatus according to claim 57, wherein the highback is mounted to the component for lateral rotation relative thereto.

66. The apparatus according to claim 57, wherein the component is a snowboard binding.

67. The apparatus according to claim 57, wherein the component is a snowboard boot.

68. The apparatus according to claim 57, wherein the component is a detachable binding interface that is constructed and arranged to interface a snowboard boot with a snowboard binding.

69. An apparatus comprising:

a component that interfaces with a rider's leg and is supportable by a gliding board;

a highback mounted to the component at an attachment location and extending upwardly through an upper portion to a top edge, the highback defining a height generally between the attachment location and the top edge, the highback being constructed and arranged to be contacted by a rear portion of the rider's leg; and a wing-shaped leg support extending in a lateral direction from the upper portion of the highback, the support having a wing portion that is constructed and arranged to cooperate with the rider's leg to transmit forces from the rider's leg to the highback, the support being adjustably movable between a plurality of positions relative to the highback so that the position of the support relative to the highback may be selectively adjusted by the rider, the support having a height that is less than the height of the highback, wherein the support includes a plurality of teeth matingly engaging the highback to maintain the support in one of the plurality of positions.

70. The apparatus according to claim 69, wherein the highback includes a plurality of teeth matingly engaging with the plurality of teeth of the support.

* * * * *